United States Patent [19]

Ruger

[11] Patent Number: 4,593,488

[45] Date of Patent: Jun. 10, 1986

[54] RECEIVER FOR BOLT ACTION FIREARM AND METHOD OF MANUFACTURE

[75] Inventor: William B. Ruger, Croydon, N.H.

[73] Assignee: Sturm, Ruger & Company, Inc., Southport, Conn.

[21] Appl. No.: 772,207

[22] Filed: Sep. 8, 1985

Related U.S. Application Data

[63] Continuation of Ser. No. 694,873, Jan. 25, 1985, abandoned.

[51] Int. Cl.[4] ..... F41C 11/00

[52] U.S. Cl. ..... 42/75 C

[58] Field of Search ..... 42/16, 75 C

[56] References Cited

U.S. PATENT DOCUMENTS 782,716 2/1905 Bennett ..... 42/16

OTHER PUBLICATIONS

Frank de Haas, *Bolt Action Rifles,* Revised, DBI Books, Northfield, Ill., 1984, pp. 57–73.

Otteson, S. *The Bolt Action,* N.Y., Winchester Press, 1976, pp. 197–211, Ts 536.6 B6087.

*Primary Examiner*—Charles T. Jordan

*Assistant Examiner*—Ted L. Parr

*Attorney, Agent, or Firm*—Pennie & Edmonds

[57] ABSTRACT

A receiver for a bolt action rifle having at least one seat surface for seating a bolt lug. The seat surface is positioned on a rearward portion of the receiver adjacent a breech opening and the surface is formed by movement of a broach through such opening.

3 Claims, 4 Drawing Figures

RECEIVER FOR BOLT ACTION FIREARM AND METHOD OF MANUFACTURE

This is a continuation of application Ser. No. 694,873, filed Jan. 25, 1985 now abandoned.

BACKGROUND OF THE INVENTION

1. Field of the Invention

This invention relates to receivers used in rifles which receivers have seating surfaces against which bolt lugs are positioned and to the method of manufacture of the receiver with such seating surfaces.

2. Prior Art

Prior rifle receivers have had spaced apart lug seating surfaces which were so positioned that manufacture of the receiver including the lug seats required numerous operational steps and often meeting required tolerances was difficult.

The present invention overcomes weaknesses of the prior art by providing a new receiver and method of manufacture.

SUMMARY OF THE INVENTION

The present invention is a receiver having forward, breech opening and rearward portions with one or more bolt lugs seats positioned on the rearward portion so that they can be readily formed by the simple broaching operation. The broach is passed through the breech opening to machine the lug seats.

It is a feature that the lug seats may after forming lie in a plane perpendicular to the bore of the rifle barrel.

It is also a feature that the receiver blank can be cast with a controlled amount of metal material in the areas adjacent the seats to be formed such that the seats can be formed in a single stroke of a broaching tool.

DESCRIPTION OF THE PREFERRED EMBODIMENTS

Figure 1:
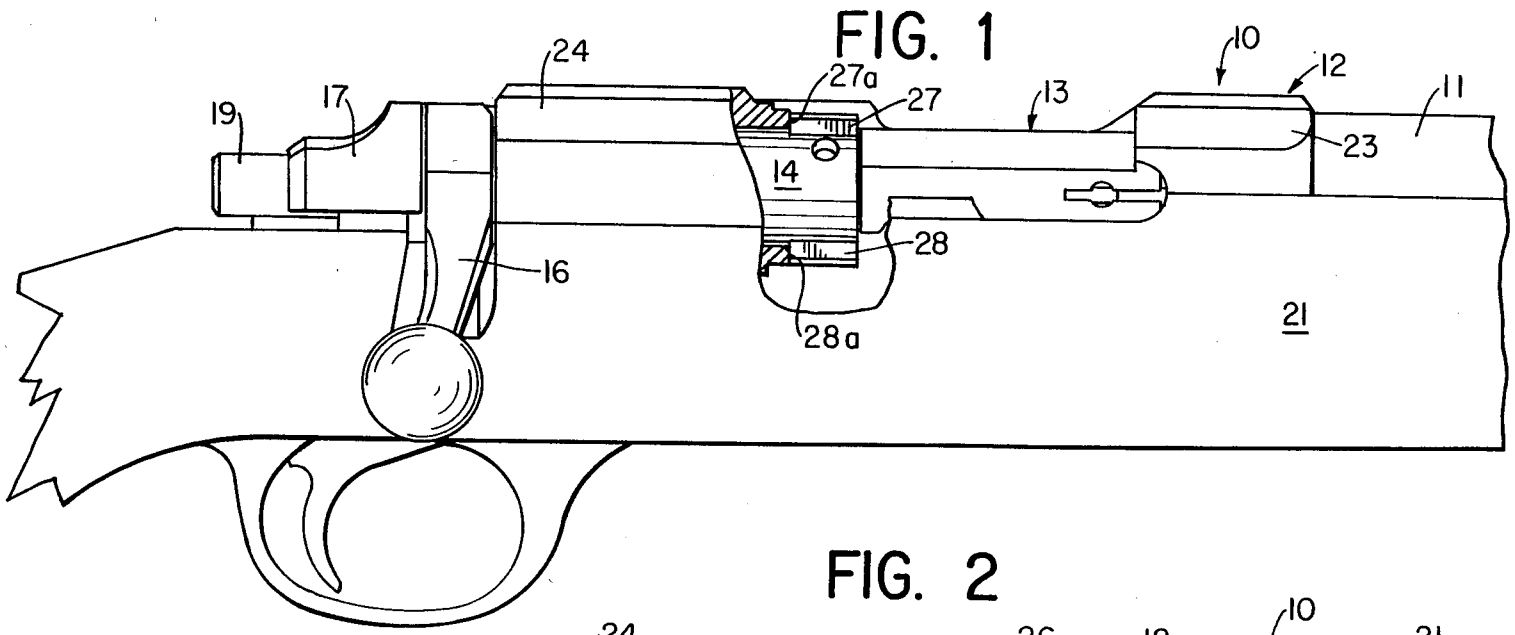
FIG. 1 is a side elevational view of a rifle, partially broken away, to show portions of the bolt including the bolt lugs and the receiver of this invention.
Figure 2:
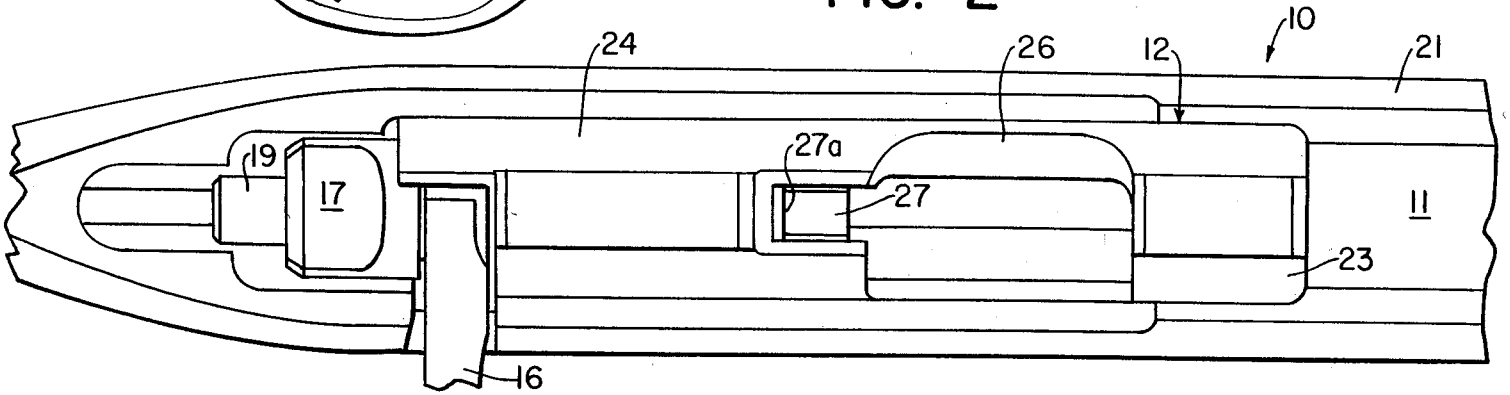
FIG. 2 is a plan view of the rifle showing the receiver.

Referring to FIGS. 1 and 2, rifle 10 includes barrel 11, receiver 12, breech bolt assembly 13, bolt 14, bolt handle 16, bolt head sleeve 17 and cocking piece 19. Also shown are stock 21 and tang 22.

Receiver 12 includes forward portion 23, rearward portion 24 and a hollow breech portion 26. Bolt 14 carries upper bolt lug 27 and lower bolt lug 28. Rearward receiver portion 24 has upper lug seat **27*a* and lower lug seat 28*a*. Bolt lugs 27 and 28 engage receiver lug seats 27*a* and 28*a* when the bolt is in its closed position (FIG. 1**).

Figure 3:
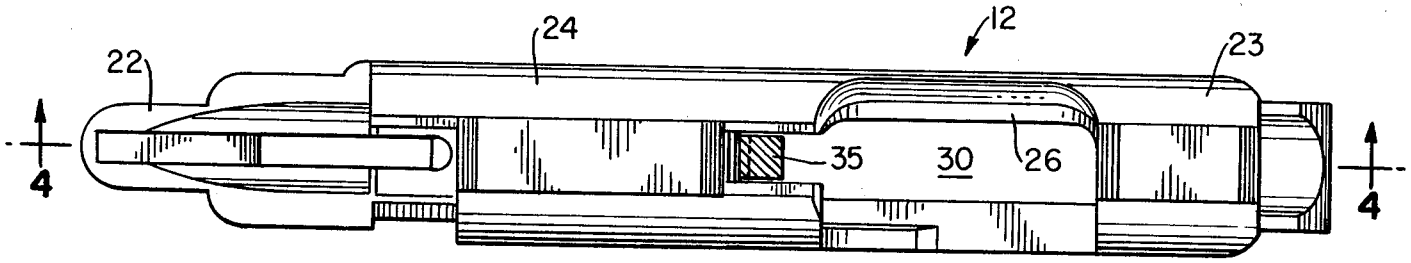
FIG. 3 is a plan view of the receiver of the invention during manufacture with the broach shown in section.
Figure 4:
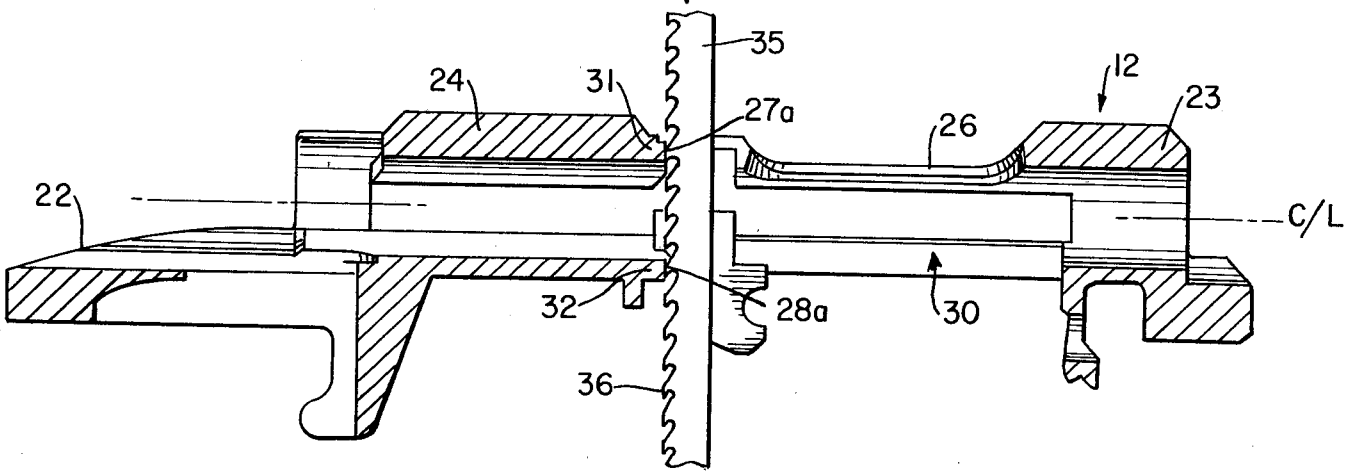
FIG. 4 is the section along line 4—4 of FIG. 3.

Turning to FIGS. 3 and 4, the method of manufacture of receiver lug seats **27*a* and 28*a* is shown in which a broach 35 is positioned in breech opening 30. Initially, the receiver blank is formed by investment casting, forging or other method. Portions of the receiver blank are then finished by machining, grinding or otherwise as known in the art. As part of this manufacturing process, the forward areas 31, 32 of the rearward portion 24 are partially removed by machining to provide the desired location of surfaces 27*a* and 28*a*. In the practice of this invention, the receiver blank includes metal material in the forward areas 31, 32 of the rearward receiver portion 24 so that metal removed from area 31, 32 by machining provides surface seats 27*a*, 28*a* of proper area and location within acceptable tolerances. Further the method of manufacture provides that the volume of metal material in areas 31, 32 preferably not exceed that which can be machined by one stroke of a broach tool. By controlling the amount of metal in areas 31, 32 seats 27*a*, 28*a*** can be formed in one broach stroke.

Referring to FIG. 4, broach tool 35 has broach teeth 36 which machine metal from the forward areas 31, 32 as broach 35 is moved downwardly (see arrow in FIG. 4). Broach 35 carries sufficient teeth of selected size, length and angle such that the machining of forward areas 31, 32 to form seat surfaces **27*a* and 28*a* is accomplished in one downward stroke. Broach 35 is preferably positioned to move perpendicularly to the axis of the barrel or a line parallel thereto (see center line C/L of FIG. 4). With broach 35 so oriented during its machining stroke, seat surfaces 27*a* and 28*a*** will be in the same plane and each seat surface equidistant from the end of barrel.

I claim:

1. A receiver for a bolt action rifle having a barrel, a bolt with lugs and a stock comprising:

(a) a receiver housing having a forward portion adapted to engage the barrel, a rearward portion adapted to engage the stock and a hollow breech portion between said forward and rearward portions, (b) at least two seat surfaces on the rearward receiver portion for mating with lugs on the bolt, said surfaces including an upper surface and a lower surface with the upper surface positioned directly above the lower surface when the bolt action rifle is in the operative position, and said surfaces being formed by a single stroke of a broach cutting means.

2. A method of manufacture of a receiver including the steps of:

(a) forming a metal receiver blank having a rearward portion with a breech opening adjacent thereto; and (b) passing a broach means through the breech opening to remove metal from the rearward portion to form at least two spaced-apart bolt lug seats thereon.

3. The method of claim 2 in which the broach means is passed through a plane perpendicular to the center line of the barrel.

* * * * *